US005293848A

United States Patent [19]

Rich et al.

[11] Patent Number: 5,293,848

[45] Date of Patent: Mar. 15, 1994

[54] SPRING RETAINER FOR A POPPET VALVE AND METHOD OF ASSEMBLING

[75] Inventors: Ronald J. Rich, Wickliffe; Frank J. Savel, III, Munson Township, Lake County, both of Ohio

[73] Assignee: TRW Inc., Lyndhurst, Ohio

[21] Appl. No.: 78,005

[22] Filed: Jun. 15, 1993

[51] Int. Cl.[5] ..... F01L 3/10

[52] U.S. Cl. ..... 123/90.67; 123/188.13; 251/337

[58] Field of Search ..... 123/90.65, 90.66, 90.67, 123/188.13; 251/337

[56] References Cited

U.S. PATENT DOCUMENTS

| | | | |
|---|---|---|---|
| 1,775,069 | 9/1930 | Finney | 251/337 |
| 2,844,134 | 7/1958 | Sietman | 123/90.67 |
| 3,612,016 | 10/1971 | Jelem | 123/90.67 |
| 4,432,311 | 2/1984 | Holtzberg et al. | 123/90.67 |
| 4,590,900 | 5/1986 | Hayashi | 123/188.13 |
| 4,653,726 | 3/1987 | Lang et al. | 251/337 |
| 4,665,869 | 5/1987 | Hinz et al. | 123/90.67 |
| 4,879,978 | 11/1989 | Pierce | 123/90.67 |
| 4,919,090 | 4/1990 | Deuring et al. | 123/90.67 |
| 4,989,556 | 2/1991 | Shiina et al. | 123/90.67 |
| 5,046,463 | 9/1991 | Worsley | 123/90.67 |
| 5,143,351 | 9/1992 | Pierce | 123/90.67 |

*Primary Examiner*—E. Rollins Cross
*Assistant Examiner*—Weilun Lo
*Attorney, Agent, or Firm*—Tarolli, Sundheim & Covell

[57] ABSTRACT

A spring retainer (10) for a poppet valve (18) which is biased by a valve spring (16) and a method of assembling the spring retainer (10) the poppet valve (18) and a valve spring (16). The spring retainer (10) has first and second body portions (30, 32). Each body portion (30, 32) has a spring flange segment (50), for engaging a valve spring (16), and a finger segment (54), for extending into a groove (26) on a valve stem (20) of the poppet valve (18). The spring retainer (10) has a slot (44) which permits relative movement between the first and second body portions (30, 32) such that the spring retainer (10) may be installed on the poppet valve (18). The spring retainer (10) has frangible web segments (36) for retaining the first and second body portions (30, 32) together prior to installment of the spring retainer (10) on the poppet valve (18). The web segments (36) break during installation of the spring retainer (10) to permit outward movement of the first and second body portions (30, 32).

21 Claims, 4 Drawing Sheets

SPRING RETAINER FOR A POPPET VALVE AND METHOD OF ASSEMBLING

BACKGROUND OF THE INVENTION

The present invention relates to a poppet valve spring retainer, and to a method for assembling a poppet valve, a valve spring and a spring retainer.

A poppet valve in an internal combustion engine is biased into a closed position by a spring. The spring acts on a spring retainer attached to a stem of the poppet valve. The force of the spring is transferred to the valve stem of the poppet valve by the spring retainer.

A spring retainer is often locked onto a valve stem by separate lock members. However, the separate lock members must be manufactured, handled and installed in addition to the manufacture, handling and installation of the spring retainer.

A spring retainer with integral locking means is known. A spring retainer with an integral locking means should be easily installed, provide sufficient locking force, and have a reasonable life.

SUMMARY OF THE INVENTION

The present invention is an improved spring retainer for a poppet valve, and is a method of assembling a poppet valve, a valve spring and a spring retainer. The poppet valve is biased by the valve spring.

The spring retainer includes first and second body portions. Each of the first and second body portions has surface means for defining a central opening which extends through the spring retainer. The opening has an axis. Each of the first and second body portions has a spring engagement surface on a spring flange for engaging the valve spring and for receiving a spring force from the valve spring. Each of the first and second body portions has finger means for engaging a valve stem of the poppet valve and for extending into a groove on the valve stem to lock the spring retainer to the valve stem.

The spring retainer has frangible means for retaining the first and second body portions together as a unitary part prior to installation of the spring retainer on the poppet valve. The frangible means breaks during installation of the spring retainer on the poppet valve to permit relative outward movement of the first and second body portions to permit passage of the valve stem between the first and second body portions during installation.

The parts are assembled by locating the valve spring concentrically about the valve stem of the poppet valve. The central opening of the spring retainer is axially aligned with the valve stem. The spring flange segments on the first and second body portions are engaged with the valve spring. A top portion of the valve stem is engaged with the finger means on the first and second body portions. The spring retainer is moved axially relative to the valve stem by applying an axial force to the spring retainer to cause a tip portion of the valve stem to pass through the central opening of the spring retainer. The valve spring is compressed due to the force applied to the valve spring by the spring engagement surfaces of the spring flanges as the spring retainer moves axially relative to the valve stem.

As the spring retainer moves axially relative to the valve stem, the frangible means is broken and the first and second body portions separate. The first and second body portions are moved away from each other due to force applied to the first and second body portions by the tip portion of the valve stem. During the relative movement of the first and second body portions the finger means pivot outward. The finger means are then pivoted inward into the groove on the valve stem to lock the spring retainer onto the valve stem.

BRIEF DESCRIPTION OF THE DRAWINGS

The foregoing and other features of the present invention will become apparent to one skilled in the art upon consideration of the following description of the invention with reference to the accompanying drawings, wherein.

DESCRIPTION OF PREFERRED EMBODIMENT

Figure 1:
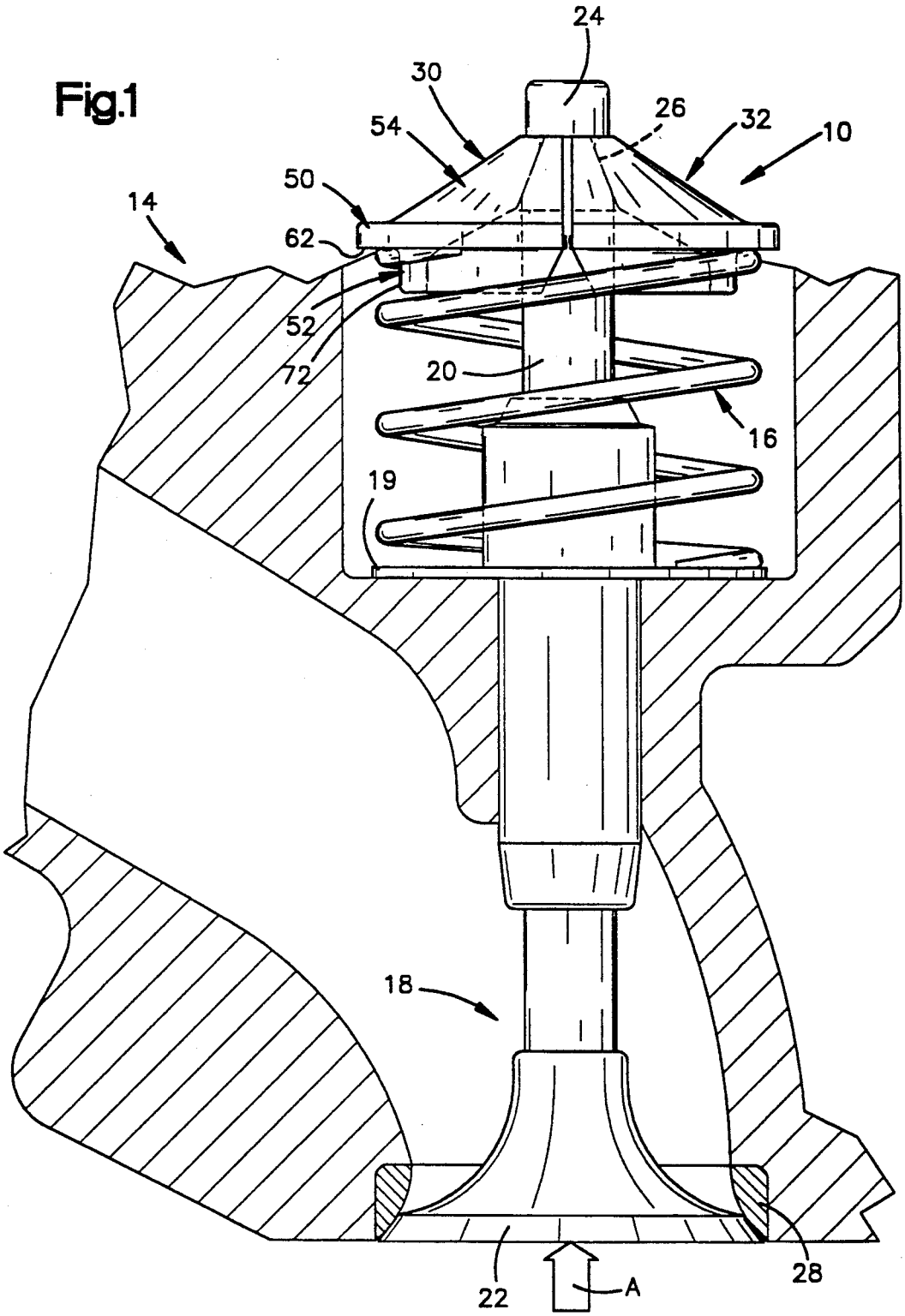
FIG. 1 is a partial sectional view of an engine with a poppet valve, a valve spring and a spring retainer embodying the present invention.

The present invention comprises a spring retainer 10 (FIG. 1) for use in an engine 14. The spring retainer 10 retains a valve spring 16 concentrically around a movable poppet valve 18. The valve spring 16 has a plurality of coils which encircle the poppet valve 18. The valve spring 16 extends between the spring retainer 10 and a spring seat 19 on the engine 14.

The poppet valve 18 includes a valve stem 20 and a head portion 22. The valve stem 20 has a tip portion 24 and a groove 26. The head portion 22 is engageable with a valve seat 28 upon movement of the poppet valve 18 to a closed position (as shown in FIG. 1). The valve spring 16 biases the poppet valve 18 to its closed position.

Figure 2:
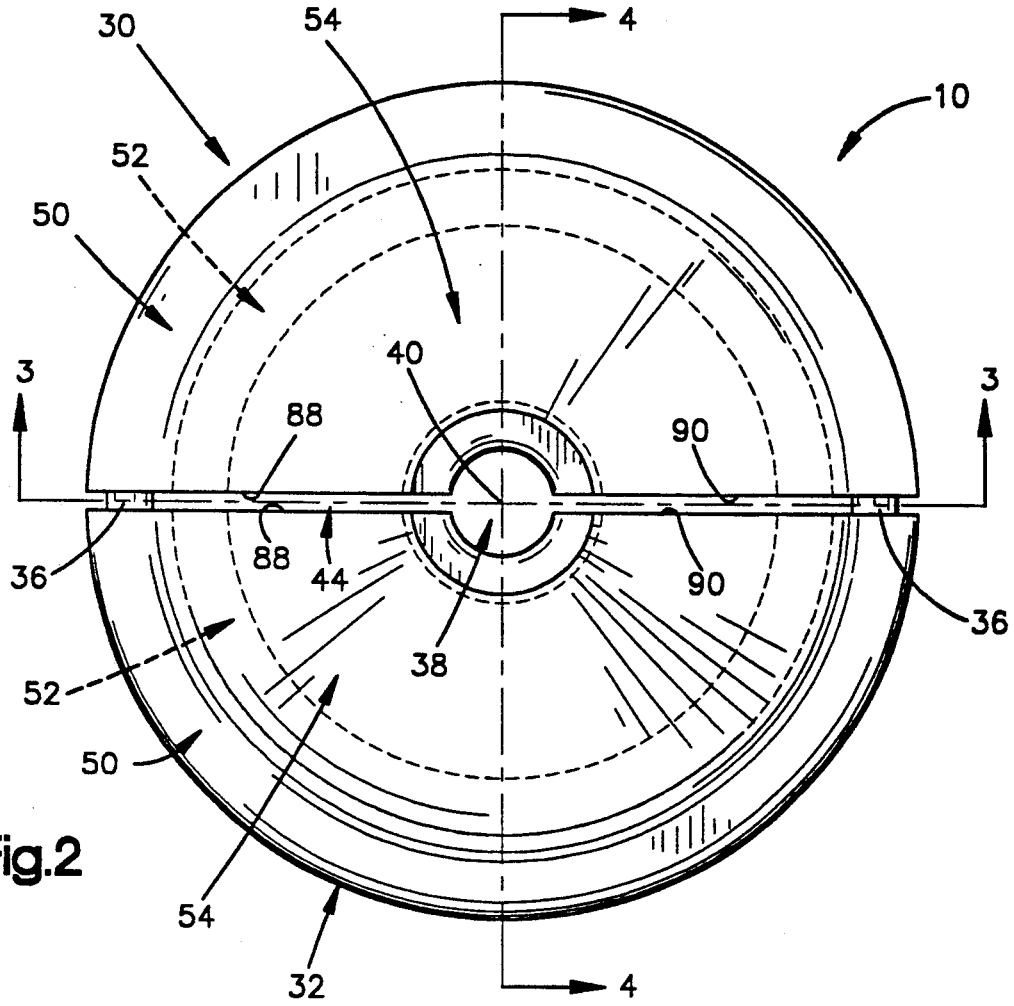
FIG. 2 is a top view of the spring retainer shown in FIG. 1.

The spring retainer 10 (FIG. 2) includes first and second body portions 30, 32 and includes two frangible web segments 36 located between the first and second body portion 30, 32. A central opening 38 extends through the spring retainer 10 along a central axis 40. The first and second body portions 30, 32, taken together, have a generally annular shape extending around the central opening 38. A slot 44 extends through the spring retainer 10 along an axial plane containing the axis 40. The slot 44 separates the first body portion 30 from the second body portion 32.

Prior to installation of the spring retainer 10 onto the poppet valve 18 (FIG. 1), the web segments 36 extend across the slot 44 to retain the first and second body portions 30, 32 together as a unitary part. During installation of the spring retainer 10 onto the poppet valve 18, the web segments 36 are broken to permit relative outward movement of the first and second body portions 30, 32 to permit passage of the valve stem 20 between the first and second body portions 30, 32 along the axis 40 of the central opening 38.

The first and second body portions 30, 32 (FIG. 2) are substantially identical and only the first body portion 30 will be described in detail, with the understanding that similarly numbered elements on the second body portion 32 identify similar structure. The first body portion 30 is located on a first side of the slot 44. The first body portion 30 extends substantially in a half-circle arc about the axis 40. The first body portion 30 (FIG. 3) has a constant radial cross-sectional area as it extends about the axis 40. The first body portion 30 includes a spring flange segment 50, a centering projection segment 52, and a finger segment 54.

Figure 3:
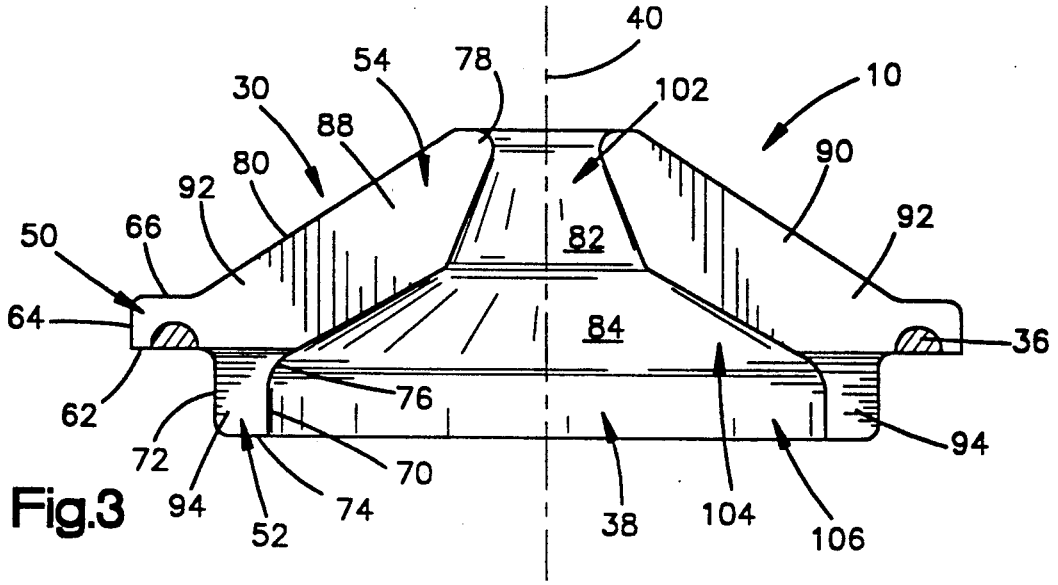
FIG. 3 is a cross-sectional view of the spring retainer taken along line 3—3 of FIG. 2.
Figure 4:
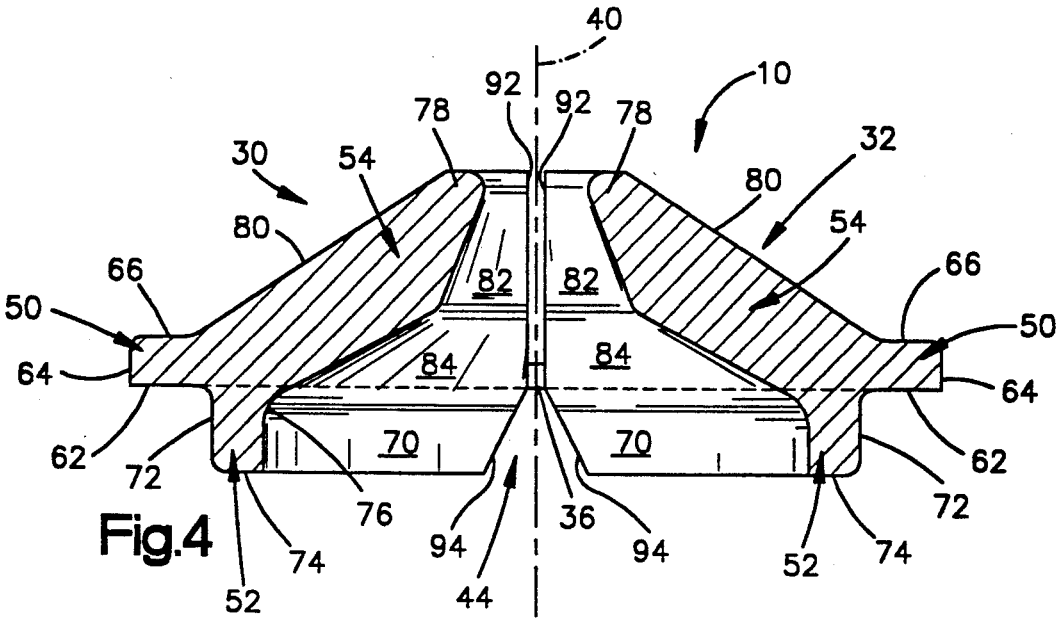
FIG. 4 is a cross-sectional view of the spring retainer taken along line 4—4 of FIG. 2.

The spring flange segment 50 extends along a radially outer periphery of the first body portion 30. The spring flange segment 50 has a spring engagement surface 62, an outer surface 64, and an upper surface 66. The spring engagement surface 62 is located on the lower (as shown in FIGS. 3 and 4) side of the spring flange segment 50. The spring engagement surface 62 lies in a plane which extends perpendicular to the axis 40. The spring engagement surface 62 (FIG. 1) engages a top coil of the valve spring 16. The upper surface 66 (FIG. 3) lies in a plane which extends perpendicular to the axis 40. The outer surface 64 lies in a generally cylindrical trace.

The centering projection segment 52 extends axially downward (as shown in FIGS. 3 and 4) from the spring flange segment 50. The centering projection segment 52 also extends partially about the axis 40 at a radial distance from the axis 40. The centering projection segment 52 has an inner surface 70, an outer surface 72, and a lower surface 74 (as shown in FIGS. 3 and 4). The inner and outer surfaces 70 and 72 lie in respective generally cylindrical traces. The inner surface 70 has a fillet portion 76. The lower surface 74 lies in a plane which extends perpendicular to the axis 40. The outer surface 72 engages the top coil of the valve spring 16 (FIG. 1) to maintain the valve spring 16 concentric about the valve stem 20.

The finger segment 54 (FIG. 3) extends axially upwardly and inwardly from the spring flange segment 50. The finger segment 54 also extends partially about the axis 40. The finger segment 54 has a tip portion 78 at the upper and inner extent of the finger segment 54. The tip portion 78 is located axially above the spring engagement surface 62 on the spring flange segment 50. The finger segment 54 has an outer surface 80, an upper inner surface 82, and a lower inner surface 84.

The outer surface 80 lies in a conical trace and tapers upward and inward from the upper surface 66 of the spring flange segment 50. The lower inner surface 84 lies in a conical trace and tapers upward and inward from the fillet 76 of the inner surface 70 of the centering projection segment 52. The upper inner surface 82 lies in a conical trace and tapers upward and inward from the lower inner surface 84 of the finger segment 54. A junction between the upper inner surface 82 and the lower inner surface 84 is located axially above the spring engagement surface 62 on the spring flange segment 50.

The incline of the upper inner surface 82 is greater than the incline of the lower inner surface 84. The finger segment 54 has a cross-section (FIG. 4) between the outer surface 80 and the upper inner surface 82 which tapers as it extends toward the tip portion 78. The tip portion 78 extends into the groove 26 (FIG. 1) on the valve stem 20 to lock the spring retainer 10 onto the valve stem 20 and to transfer a spring force to the valve stem 20.

The first body portion 30 (FIG. 2) terminates at first and second slot surfaces 88, 90. The first and second slot surfaces 88, 90 define the slot 44. Each slot surface 88, 90 has an upper portion 92 (FIG. 3) and a lower portion 94. The upper portions 92 are located at the spring flange segment 50 and the finger segment 54. The upper portions 92 lie in a plane parallel to the axis 40. The lower portions 94 of the slot surfaces 88, 90 are located at the centering projection segment 52. The lower portions 94 (FIG. 4) slant outwardly and downwardly to taper away from the plane of the upper portions 92 such that the slot 44 has an increased width at the centering projection segment 52.

Figure 5:
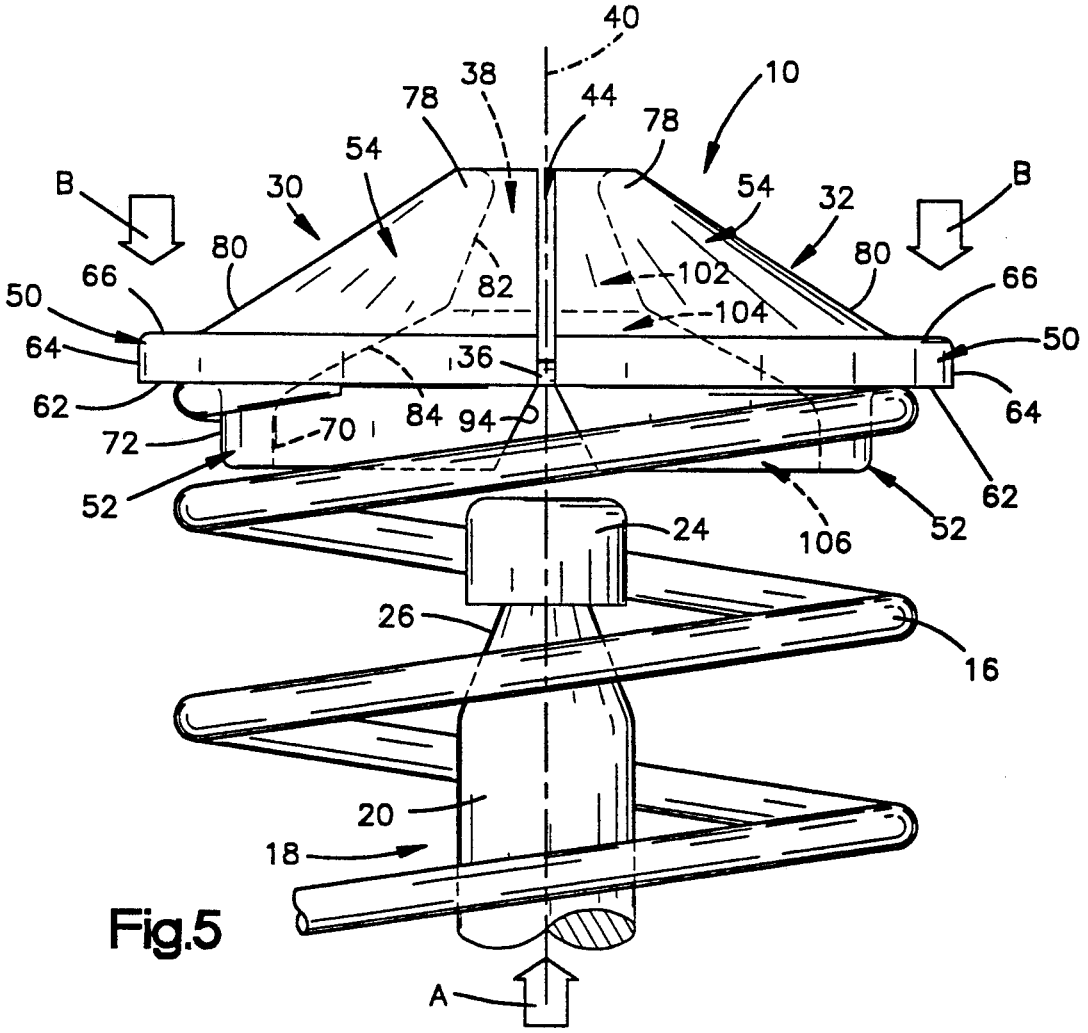
FIGS. 5, 6, and 7 are views showing the assembly of the poppet valve, the valve spring and the spring retainer.

The slot 44 and the central opening 38 intersect. The central opening 38 (FIG. 3) has an upper portion 102, a middle portion 104, and a lower portion 106. The upper portion 102 is defined by the upper inner surfaces 82 of the finger segments 54 of the first and second body portions 30, 32. The upper portion 102 is located axially above the spring engagement surface 62 on the spring flange segment 50. The upper portion 102 of the central opening 38 has a truncated cone shape, with a diameter which decreases upwardly along the axis 40. The upper portion 102 is sized such that the tip portion 24 (FIG. 5) of the valve stem 20 will engage the upper inner surfaces 82 when the valve stem 20 is forced along the central opening 38.

The middle portion 104 (FIG. 3) is defined by the lower inner surfaces 84 of the finger segments 54 of the first and second body portions 30, 32. The middle portion 104 of the central opening 38 has a truncated cone shape, with a diameter which decreases upwardly along the axis 40. The size of the diameter of the middle portion 104 is greater than the size of the diameter of the upper portion 102. The middle portion 104 may be sized such that the tip portion 24 of the valve stem 20 will engage the lower inner surfaces 84 of the finger segments 54 when the valve stem 20 (FIG. 5) is moved into the central opening 38. The lower portion 106 (FIG. 3) of the central opening 38 is defined by the inner surfaces 70 of the centering projection segments 52 of the first and second body portions 30, 32. The lower portion 106 has a generally cylindrical shape.

The two frangible web segments 36 (FIG. 2) extend from the first and second slot surfaces 88, 90 at the spring flange segments 50. The web segments 36 extend across the slot 44 to connect the first and second body portions 30, 32 together. The web segments 36 (FIG. 3) each have a sufficiently small cross-section to permit breaking or fracture of the web segments 36 upon installation of the spring retainer 10 onto the poppet valve 18 (FIG. 1). Typically, the cross-sectional area of the web segments 36 is a small fraction of the area of the respective slot surface 88, 90.

The spring retainer 10 is fabricated as a unitary part. This enables handling of the spring retainer 10 without loss of either the first or second body portions 30, 32. The spring retainer 10 is made of a material which has high strength and relatively low flexibility. The material provides desired stiffness and durability to the spring retainer 10. The material is preferably a moldable polymeric material such as plastic composite. In the preferred embodiment, the material is AMODEL ®1133 H.S., marketed by Amoco Oil Co.

During installation, the top coil of the valve spring 16 (FIG. 5) is press fit around the centering projection segment 52 of the spring retainer 10. Thus, the spring retainer 10 and valve spring 16 are handled as a unit. Moreover, the top coil of the valve spring 16 entraps the first and second body portions 30, 32 to prevent loss.

The poppet valve 18 is positioned in the engine 14 as shown in FIG. 1. An upward restraining force A is applied by a tool (not shown) to the poppet valve 18 to hold the head portion 22 in engagement with the valve seat 28 and prevent movement of the poppet valve 18 during installation. The spring retainer 10 (FIG. 5) and the valve spring 16 are positioned coaxially with the valve stem 20. The spring retainer 10 and the valve spring 16 are moved downwardly relative to the valve stem 20 by a force B (shown schematically) applied to the upper surface 66 of the spring flange segments 50 by a tool (not shown), which has a generally circular engagement surface, such that the coils of the valve spring 16 encircle the valve stem 20 and engage the spring seat 19 (FIG. 1). The force B is applied to the spring retainer 10 along the extent of each upper surface 66. As the spring retainer 10 is moved further downwardly, the valve spring 16 is compressed and thereby preloaded.

Figure 6:
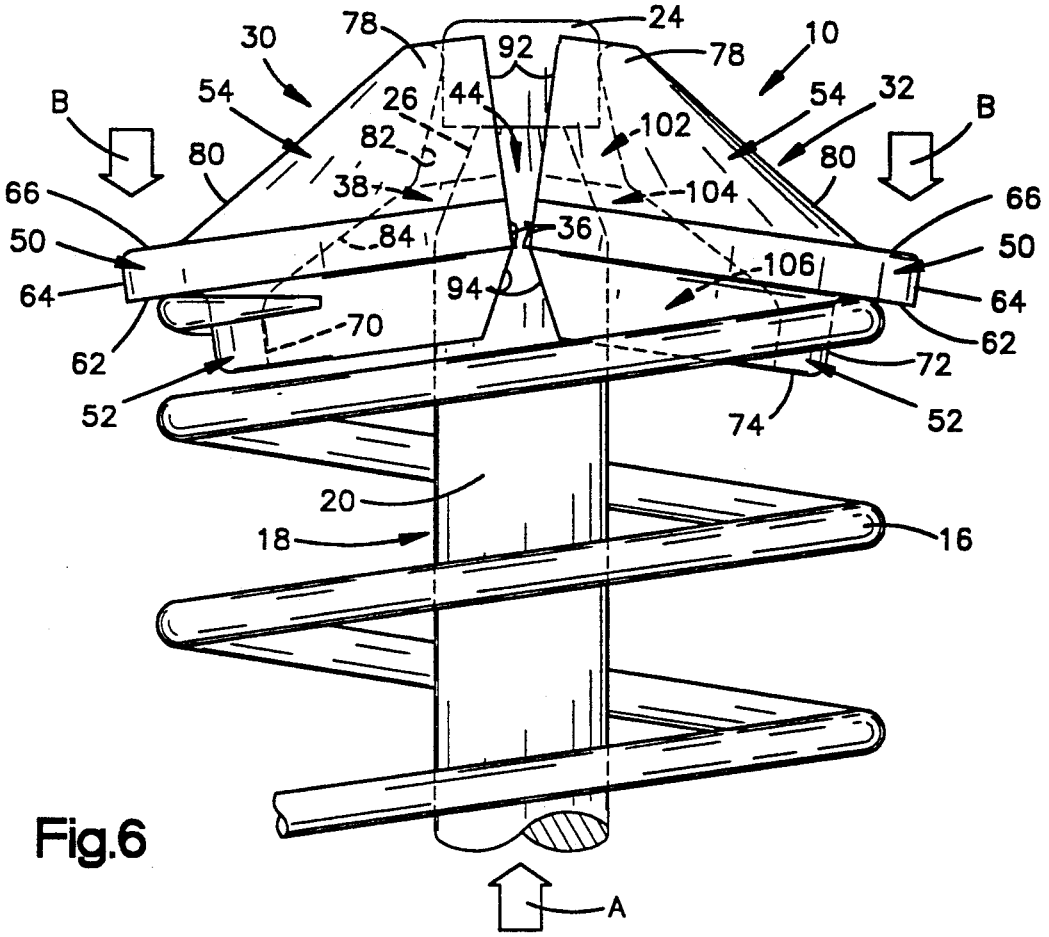

As the spring retainer 10 (FIG. 6) is moved further downwardly relative to the valve stem 20, the tip portion 24 enters and moves axially along the central opening 38 of the spring retainer 10. The tip portion 24, which has a greater diameter than the upper portion 102 of the central opening 38 engages the finger segments 54 of the first and second body portions 30, 32. The tip portion 24 of the valve stem 20 may engage the lower inner surfaces 84 of the finger segments 54 prior to engagement of the tip portion 24 with the upper inner surfaces 82 of the finger segments 54, dependent upon the diameter of the tip portion 24.

As the tip portion 24 moves along the central opening 38, the tip portion 24 bears on the finger segments 54. The tip portion 24 causes the first and second body portions 30, 32 to pivot at the web segments 36 such that the finger segments 54 pivot upwardly and outwardly. As the first and second body portions 30, 32 pivot, the engagement surface of the tool (not shown) may separate from a portion of each of the upper surfaces 66. However, the engagement surface of the tool remains in contact with at least a portion of each of the upper surfaces 66 such that the force B is applied to move the first and second body portions 30, 32 relative to the valve stem.

The outward and downward slant of the lower portions 94 of the slot surfaces 88, 90 permit the first and second body portions 30, 32 to pivot without binding. The pivoting of the first and second body portions 30, 32 cause the slot 44 and the central opening 36 to open slightly. Also, the pivoting of the first and second body portions 30, 32 causes increased stress in the web segments 36.

As the tip portion 24 bears on the finger segments 54, the tip portion 24 cams along the upper inner surfaces 82 or the lower inner surfaces 84 of the finger segments 54. The conical taper of the upper inner surfaces 82, or the lower inner surfaces 84, translates the axial force from the tip portion 24 into outward force which acts on the first and second body portions 30, 32. The outward force pushes the first and second body portions 30, 32 outwardly. The outward movement of the first and second body portions 30, 32, stresses the web segments 36. The stress on the web segments 36 causes the web segments 36 to break or fracture.

After the web segments 36 are broken the first and second body portions 30, 32 move further outward against an inward bias provided by the top coil of the valve spring 16. The entrapment and the inward bias provide by the top coil of the valve spring 16 prevent loss of the first and second body portions 30, 32. The outward movement of the first and second body portions 30, 32 increases the separation between the first and second body portions 30, 32 at the slot 44. Also, the central opening 38 is elongated into an elliptical shape sufficiently large to permit passage of the tip portion 24 axially through the central opening 38 and past the tip portions 78 of the finger segments 54.

Once the tip portion 24 of the valve stem 20 moves past the spring retainer 10, the tip portions 78 of the finger segments 54 are radially aligned with the groove 26 on the valve stem 20. The inward bias of the top coil of the valve spring 16 moves the first and second body portions 30, 32 inwardly. The tip portions 78 of the finger segments 54 are pivoted downwardly and inwardly to extend into the groove 26. The upper inner surfaces 82 of the finger segments 54 engage the valve stem 20 at the groove 26. The tip portions 78 of the finger segments 54 extend under the tip portion 24 of the valve stem 20.

Figure 7:
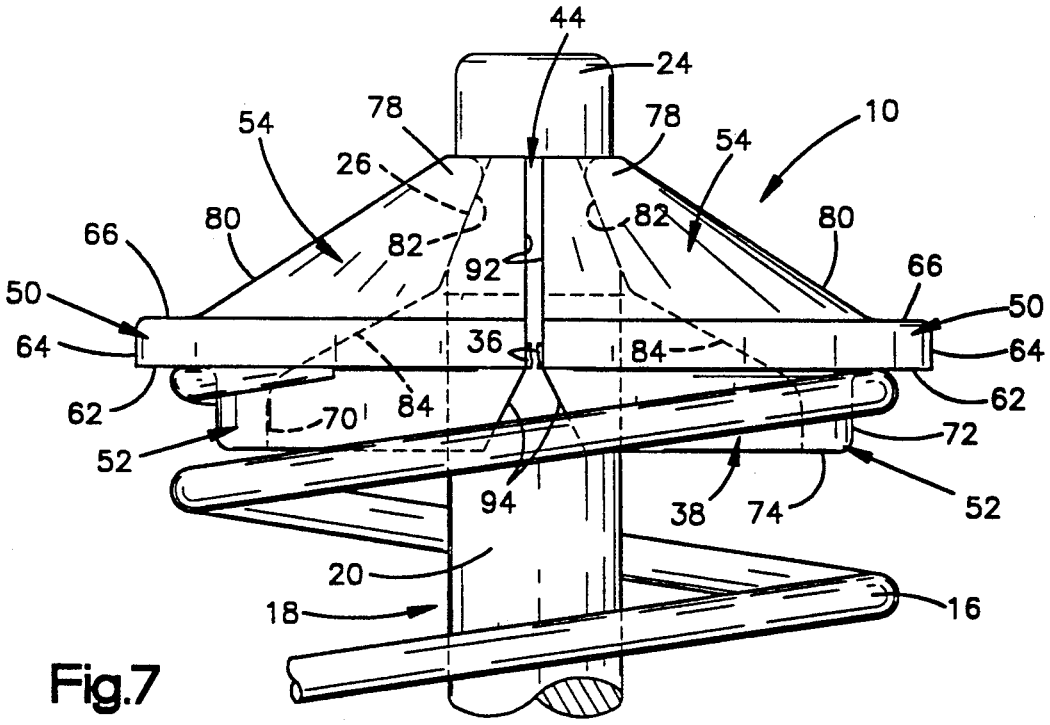

The forces A and B are removed (FIG. 7) and installation is complete and the spring retainer 10 is now effectively locked onto the valve stem 20 of the poppet valve 18. The inward bias of the top coil of the valve spring 16 holds the first and second body portions 30, 32 inward and prevents loss of the first and second body portions 30, 32. Also, the tendency of the finger segments 54 to pivot inwardly and downwardly into the groove 26 ensures, due to axial force from the valve spring 16, that the spring retainer 10 remains locked to the valve stem 20. The pieces of the broken web segments 36 remain attached to the first and second body portions 30, 32 and are trapped within the spring retainer 10.

The present invention allows a one-piece manufacture of a spring retainer which has improved strength such that improved retainer stiffens is achieved without the need for flexibility. Moreover, ease of assembly and disassembly is accomplished.

From the above description of the invention, those skilled in the art will perceive improvements, changes and modifications. Such improvements, changes and modifications within the skill of the art are intended to be covered by the appended claims.

Having described the invention, the following is claimed:

1. An apparatus for use with a poppet valve having a valve stem, the valve stem having a groove, the poppet valve being biased by a valve spring, said apparatus comprising a spring retainer comprising:

first and second body portions, each of said first and second body portions having surface means for defining a central opening extending through said spring retainer, said central opening having an axis, each of said first and second body portions having a spring engagement surface means for engaging the valve spring and for receiving a spring force from the valve spring, each of said first and second body portions having finger means for engaging the valve stem and for extending into the groove on the valve stem to lock said spring retainer to the valve stem; and frangible means for retaining said first and second body portions together as a unitary part prior to installation of said spring retainer on the poppet valve and for breaking during installation of said spring retainer on the poppet valve to permit relative outward movement of said first and second body portions to permit passage of the valve stem between said first and second body portions during installation.

2. An apparatus as set forth in claim 1, wherein said spring retainer is one-piece.

3. An apparatus as set forth in claim 1, wherein said spring retainer has a slot means for permitting relative movement between the first and second body portions, said slot means extending axially through said spring retainer and separating said first body portion from said second body portion, said slot means being defined by slot surfaces on said first and second body portions.

4. An apparatus as set forth in claim 3, wherein said frangible means includes a web segment which extends between said slot surfaces on said first and second body portions.

5. An apparatus as set forth in claim 4, wherein said web segment extends from said slot surfaces at the spring engagement surface means.

6. An apparatus as set forth in claim 3, wherein each of said first and second body portions includes a centering projection means for retaining said valve spring centered coaxially with the valve stem, said slot means including a slot which extends in a plane containing the axis of said central opening, said slot surfaces including surfaces on said finger means, said spring engagement surface means and said spring centering means, said slot surfaces being tapered at said centering projection means such that said slot has an increased width at the centering projection for preventing binding during installation of said spring retainer.

7. An apparatus as set forth in claim 1, wherein said finger means have an inner surface which partially defines said central opening, said inner surface of said finger means being located axially from said spring engagement surface means, said inner surface of said finger means having a conical taper, said conical taper of said inner surface tapering axially and inwardly away from said spring engagement surface means.

8. An apparatus as set froth in claim 1, wherein the valve stem has a tip portion, said surface means for defining said central opening including a surface portion located a distance from said axis, said distance being selected such that the tip portion of the valve stem engages said surface portion and bears upon said surface portion upon movement of the valve stem along the axis of said central opening during installation of said spring retainer on the poppet valve.

9. An apparatus as set forth in claim 1, wherein said spring engagement surface means being a spring flange with a surface for engaging the valve spring; said spring flange extending at a radial outer periphery of said spring retainer, said finger means extending axially and inwardly from said spring flange.

10. An apparatus comprising:

a poppet valve having a valve stem with an axis, said valve stem having a groove;

a valve spring for biasing said poppet valve, said valve spring having a plurality of coils which encircle said valve stem; and a spring retainer for retaining said valve spring, said spring retainer having first and second body portions, each of said first and second body portions having surface means for defining a central opening extending through said spring retainer, said central opening being coaxial with said valve stem, each of said first and second body portions having a spring engagement surface means for engaging said valve spring and for receiving a spring force from said valve spring, each of said first and second body portions having finger means for engaging said valve stem and for extending into said groove on said valve stem to lock said spring retainer to said valve stem;

said spring retainer having frangible means for retaining said first and second body portions together as a unitary part prior to installation of said spring retainer on said poppet valve and for breaking during installation of said spring retainer on said poppet valve to permit relative outward movement of said first and second body portions to permit passage of said valve stem between said first and second body portions during installation.

11. An apparatus as set forth in claim 10, wherein said spring retainer is one-piece.

12. An apparatus as set forth in claim 10, wherein said spring retainer has a slot means for permitting relative movement between the first and second body portions, said slot means extending axially through said spring retainer and separating said first body portion from said second body portion, said slot means being defined by slot surfaces on said first and second body portions, said frangible means including a web segment located within said slot means, said web segment extending between said slot surfaces on said first and second body portions.

13. An apparatus as set forth in claim 10, wherein said poppet valve and said spring retainer include cooperating surface means for providing outwardly directed force to said first and second body portions upon relative axial movement of said spring retainer relative to said poppet valve such that said frangible means is stressed and broken.

14. An apparatus as set forth in claim 10, wherein said valve spring includes means for entrapping said first and second body portion to prevent loss of one of said first and second body portions.

15. An apparatus as set forth in claim 10, wherein said valve spring includes means for biasing said first and second body portion inwardly toward said valve stem.

16. An apparatus as set forth in claim 10, wherein said spring retainer includes means for retaining said frangible means connected to said spring retainer when said frangible means is broken.

17. A method of assembling a poppet valve, a valve spring and a spring retainer, the spring retainer having a body with first and second body portions, the spring retainer having a frangible connector web located between the first and second body portions, said method comprising:

locating the valve spring concentrically about a valve stem of the poppet valve;

axially aligning a central opening of the spring retainer with the valve stem;

engaging a spring flange segment on each of the first and second body portions with the valve spring;

engaging a tip portion of the valve stem with a finger segment of each of the first and second body portions;

moving the spring retainer axially relative to the valve stem by applying an axial force to the spring retainer to cause the tip portion of the valve stem to pass through the central opening of the spring retainer;

compressing the valve spring due to force applied to the valve spring by the spring flange segments as the spring retainer moves axially relative to the valve stem;

breaking the frangible connector web between the first and second body portions such that said first body portion is separated from said second body portion as the spring retainer moves axially relative to the valve stem;

relatively moving the first and second body portions due to force applied to the first and second body portions by the tip portion of the valve stem including pivoting the finger segments outward and pushing the first and second body portions outward relative to the valve stem; and pivoting the finger segments inward into a groove on the valve stem to lock the spring retainer onto the valve stem.

18. A method as set forth in claim 17, wherein said step of moving said spring retainer axially relative to the stem includes moving a surface of the spring retainer against a surface of the valve stem to translate axial force to radially outward force pushing on the first and second body portions.

19. A method as set forth in claim 17, including retaining the broken frangible connector web attached to the spring retainer after the frangible connector web is broken.

20. A method as set forth in claim 17, wherein said step of relatively moving the first and second body portions includes pivoting the first and second body portions for enlarging the central opening and for causing stress in the frangible connector web.

21. A spring retainer for an engine valve comprising generally circular body having an axial bore adapted to receive a stem of an engine valve, wherein said body comprises plural distinct, relatively inflexible, circumferentially spaced pieces, each having a surface defining a circumferential portion of said bore, and frangible means for holding said pieces in circumferential and axial alignment, said frangible means being designed to fracture when the stem of an engine valve is forced through said bore.

* * * * *